United States Patent [19]

Gaither

[11] 4,443,163

[45] Apr. 17, 1984

[54] FLUID MOTOR OR PUMP

[76] Inventor: Luis A. Gaither, 100 Summerstone, Irvine, Calif. 92714

[21] Appl. No.: 398,547

[22] Filed: Jul. 15, 1982

[51] Int. Cl.[3] ..... F04B 19/02; F01B 9/00; F01B 15/00

[52] U.S. Cl. ..... 417/466; 417/534; 92/117 A; 92/138; 91/196

[58] Field of Search ..... 417/466, 510, 515, 518, 417/534; 92/117 R, 117 A, 138; 91/196

[56] References Cited

U.S. PATENT DOCUMENTS

| | | | |
|---|---|---|---|
| 1,474,769 | 11/1923 | Dunning | 417/534 |
| 3,453,968 | 7/1969 | Wortley | 417/515 |
| 3,835,823 | 9/1974 | Miller | 91/196 |

FOREIGN PATENT DOCUMENTS

| | | | |
|---|---|---|---|
| 680132 | 8/1939 | Fed. Rep. of Germany | 417/466 |

*Primary Examiner*—William L. Freeh
*Assistant Examiner*—Paul F. Neils

[57] ABSTRACT

A fluid motor or pump that has a front wall, four corner conduits, two lateral conduits, a chamber, two pistons, a piston rod and a crank, in which the rotary motion of the crank is transformed to a vertical sliding motion of the chamber and a horizontal sliding motion of the pistons, that result in continuous fluid motion or vice versa. The front wall supports the crankshaft and the corner conduits. The corner conduits hold and communicate with the lateral conduits. The lateral conduits communicate with the chamber internal areas and allow the chamber to slide. The chamber controls the fluid flow and allows the pistons, joined by the piston rod, to slide. The pistons' sliding motion causes the fluid to flow and the piston rod to move. The piston rod movement causes continuous rotary motion of the crankshaft or vice versa.

4 Claims, 2 Drawing Figures

FLUID MOTOR OR PUMP

SUMMARY OF THE INVENTION

This invention relates to improvements in fluid motors and pumps. More particular, this invention relates to improvements in piston displacement fluid motors, pumps or alike mechanisms.

The fluid motor or pump is a mechanical device that transforms rotary mechanical motion to continuous fluid motion or vica versa.

The fluid motor or pump has an external frame, two lateral dual conduits, a chamber, two pistons, a piston rod, a crankrod and two cranks.

The external frame, that supports the fluid motor or pump structure, has a front wall, a back wall and four corner conduits.

The external frame front and back walls support and allow the cranks to rotate. The corner conduits hold and connect to te lateral dual conduits.

The lateral dual conduits support and allow the chamber to slide up and down. Within the chamber the piston rod and pistons slide. The piston rod joins the pistons and causes one piston to move toward the center of the chamber as the other piston moves away from the chamber center.

The piston rod center, holds the crankrod that extends toward the external frame walls. The crankrod connects, via the crankrollers, to the cranks that communicate to the exterior via the crankshaft.

The chamber movement and position causes the fluid to flow from only one side of the lateral conduits. As the chamber passes a centered position the fluid will flow thru the opposite side of the lateral conduits.

As mechanical rotary motion is applied, the cranks will rotate. The cranks movement will cause the pistons and chamber to slide. The pistons movement will cause fluid to flow to and from the chamber. The chamber movement will control the correct fluid direction and continuous fluid motion is obtained.

As continuous fluid motion is applied, the pistons will slide and cause the cranks to rotate. As the cranks rotate, the chamber will slide and control the correct fluid direction. The correct fluid flow will allow the cycle to complete and a continuous crankshaft rotary motion is obtained.

DRAWINGS DESCRIPTION

DETAILED DESCRIPTION

Figure 1:
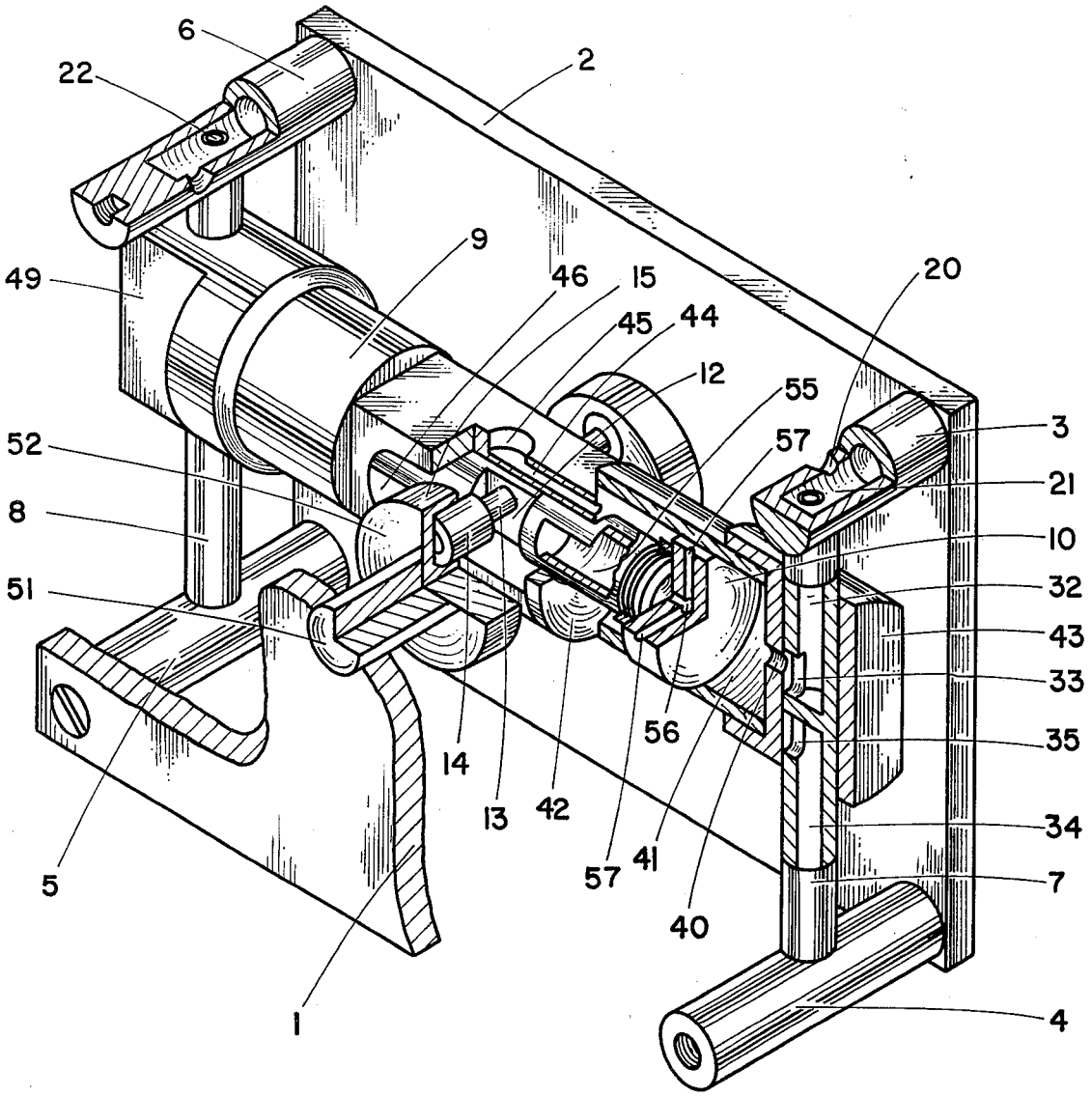
FIG. 1 is a perspective sectional view of the fluid motor or pump. Parts of the device are sectioned and other parts have been partially removed.

Referring to FIG. 1 in detail, the external frame front wall 1, supports and allows the front crankshaft 51 to rotate. In the same manner the external frame back wall 2, supports and allows the back cranckshaft to rotate.

The external frame corner conduits 3 and 4, hold and connect to the lateral dual conduit 7. The corner conduits 5 and 6, hold and connect to the lateral dual conduit 8. The external frame corner conduit 3 allows the lateral dual conduit internal cavity 32 to communicate to the exterior via the corner conduit cavities 20–21. The corner conduit 4 allows the lateral dual conduit internal cavity 34 to communicate to the exterior. In the same manner the corner conduits 5 and 6 allow the lateral dual conduit 8 to communicate to the exterior.

The lateral dual conduits 7 and 8, allow the chamber 9 closing walls 43 and 49 to slide up and down, thus allowing the whole chamber to slide vertically. The lateral conduit 7, via the internal areas 33 and 35, communicates with the chamber internal port 40 and area 41. In the same manner the lateral dual conduit 8, communicates with the chamber left internal port and area.

The piston 10 slides within the chamber internal areas 41 and 42. In the same manner the other piston slides within the chamber internal left areas. The piston rod 12 slides within the chamber internal center areas and joins the right piston 10 with the left piston. The piston rod causes one piston to move toward the center of the chamber 46 and the other piston to move away from the chamber center.

The piston rod center holds and allows the crankrod to rotate. The crankrod 13 extends to the front and back crankwheels. The front crankroller 14 is mounted and spins in the front part of the crankrod and within the front crankwheel 52. In the same manner the back crankroller is mounted and spins in the back part of the crankrod and within the back crankwheel.

Mechanical rotary motion applied to the fluid motor or pump front crank 15, will cause the crankwheel 52 to rotate. The crankwheel rotation, via the crankroller 14, will cause the crankrod 13 and the whole chamber 9 to move. The crankrod movement, via the piston rod 12, will cause the right piston 10 to move and slide and within the chamber 9 internal areas 41 and 42. In the same manner the piston rod 12 will cause the left piston to move and slide within the chamber left internal areas. As the piston 10 moves away from the chamber center 46, fluid will flow from the chamber internal area 41, to the hose or external device connected to the corner conduit 3, via the chamber internal port 40 and the lateral dual conduit upper internal areas 32–33. As the right piston moves away from the chamber center, the left piston will move toward the chamber center and fluid will be forced, from the hose or external device connected to the corner conduit 6, to the chamber left internal area. As the chamber 9 moves down and passes a centered position, the piston 10 will move toward the center of the chamber and fluid will be forced, from the hose or external device connected to the corner conduit 4, via the lateral dual conduit lower internal areas 34–35, to the chamber internal port 40 and area 41. As the piston 10 moves toward the center of the chamber, the left piston will move away from the chamber center and fluid will flow from the chamber to the hose or external device connected to the corner conduit 5.

Steam, gas pressure or alike fluid motion applied to the fluid motor or pump corner conduits 4 and 6 will cause a continuous rotary motion in the crankshaft 51. Fluid forced into the chamber 9 left internal areas, via the corner conduit 6 and the lateral dual conduit 8 upper internal areas, will cause the left piston to slide toward the chamber center 46. The left piston movement, via the piston rod 12, will cause the right piston 10 to slide away from the chamber center. As the piston 10 slides, fluid from the chamber area 41 is forced to flow to the hose or external device connected to the corner conduit 3, via the lateral dual conduit internal areas 32–33. As the piston rod 12 moves, the crankrod 13, via the crankroller 14, will move the chamber and cause the crankwheel 52 to rotate. The crankwheel 52 rotation will cause a continuous mechanical rotary motion in the crankshaft 51. As the chamber 9 moves down and passes a centered position, the fluid applied to the corner conduit 4 will be forced into the chamber internal area 41, via the lateral dual conduit 7 lower internal areas 34–35 and the chamber internal port 40, causing piston 10 to move toward the chamber center 46. The piston movement via the piston rod 12, will move the left piston away from the chamber center causing the fluid from the chamber left internal area to flow to the hose or external device connected to the corner conduit 5.

The fluid motor or pump configuration, allows for the pistons sliding path to be lubricated. Lubricant can be applied to the piston 10 sliding center via the piston internal conduits 56–57 and the piston rod hollow center 55.

The fluid motor or pump has a secondary fluid source that can be used as a cooling system. As the piston 10 slides within the chamber 9, fluid will flow from and to the chamber internal area 42, via the chamber upper conduits 44–45. In the same manner, as the left piston slides, fluid will flow from and to the chamber left internal area, via the chamber lower conduits. To the chamber lower conduit and upper conduit 45, a hose or external device can be connected to allow for air, water or any other fluid to flow, not only from the chamber exterior, but from another external source.

Figure 2:
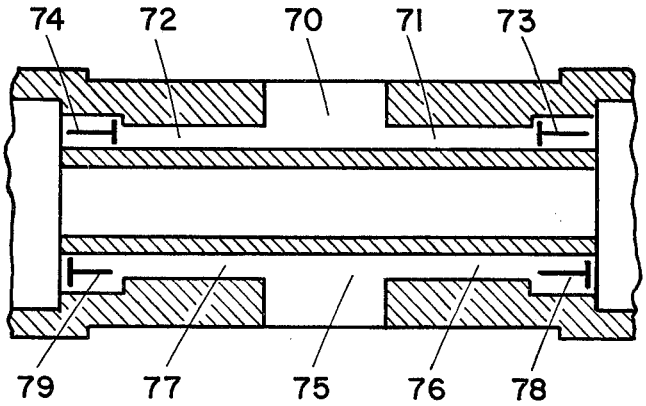
FIG. 2 is a frontal sectional view of the alternative chamber conduits.

Referring to FIG. 2 in detail, the fluid motor or pump alternative chamber conduits would allow a directional secondary fluid source. The upper communication area 70 and conduits 71–72 with one way directional valves 73 and 74, allow fluid to flow only from the chamber internal centered areas to the exterior, while the lower communication area 75 and conduits 76 and 77, allow fluid to flow only from the exterior to the chamber internal centered areas. The directional fluid flow is not affected by the sliding direction of the fluid motor or pump pistons.

What I claim is:

1. A fluid motor or pump which comprises a front crank, a piston rod, a right piston, a left piston, a chamber, a right lateral conduit, a left lateral conduit, an upper left corner conduit, an upper right corner conduit, a lower right corner conduit, a lower left corner conduit and a front wall which holds said four corner conduits, said front wall supports said front crank and allows the crankshaft to rotate, said corner conduits communicate with said lateral conduits and the exterior, said upper right corner conduit and said lower right corner conduit hold and communicate with said right lateral conduit, said right lateral conduit internal upper area communicates with said upper right corner conduit and said right lateral conduit internal lower area communicates with said lower right corner conduit, said upper left corner conduit and said lower left corner conduit hold and communicate with said left lateral conduit, said left lateral conduit internal upper area communicates with said upper left corner conduit and said left lateral conduit internal lower area communicates with said lower left corner conduit, said lateral conduits support and allow said chamber to slide, said chamber has a main frame and two end walls, said chamber main frame has two internal end areas and a centered area, said chamber main frame has an upper conduit that allows said chamber right end internal area to communicate to the exterior, said chamber main frame has a lower conduit that allows said chamber left end internal area to communicate to the exterior, said chamber right end wall centered port allows said right lateral conduit internal areas to communicate with said chamber right end internal area, said chamber left end wall centered port allows said left lateral conduit internal areas to communicate with said chamber left end internal area, said chamber right end internal area allows said right piston to slide, said chamber left end internal area allows said left piston to slide, said chamber centered area allows said piston rod to slide and join said pistons, said piston rod center holds and allows the crankrod of said front crank to spin, said piston rod via said crankrod and the crankroller of said front crank communicates its sliding motion to said front crank causing a rotary motion of the crankwheel and crankshaft of said front crank or vice versa, said front crank via said crankroller causes said chamber to slide, said chamber sliding motion and position controls the fluid flow from said chamber internal areas to said lateral conduits or vice versa, said fluid flow is caused by the sliding motion of said pistons or vice versa, said fluid flow forced into and out of said fluid motor or pump will cause said fluid motor or pump to act as a motor, said crankshaft rotary motion will force fluid to flow into and out of said fluid motor or pump and cause said fluid motor or pump to act as a pump.

2. A fluid motor or pump which comprises a front crank, a back crank, a piston rod, a right piston, a left piston, a chamber, a right lateral conduit, a left lateral conduit, an upper left corner conduit, an upper right corner conduit, a lower right corner conduit, a lower left corner conduit and front and back walls which hold said four corner conduits, said back wall supports said back crank and allows the crankshaft of said back crank to rotate, said front wall supports said front crank and allows the crankshaft of said front crank to rotate, said corner conduits communicate with said lateral conduits and the exterior, said upper right corner conduit and said lower right corner conduit hold and communicate with said right lateral conduit, said right lateral conduit internal upper area communicates with said upper right corner conduit and said right lateral conduit internal lower area communicates with said lower right corner conduit, said upper left corner conduit and said lower left corner conduit hold and communicate with said left lateral conduit, said left lateral conduit internal upper area communicates with said upper left corner conduit and said left lateral conduit internal lower area communicates with said lower left corner conduit, said lateral conduits support and allow said chamber to slide, said chamber has a main frame and two end walls, said chamber main frame has two internal end areas and a centered area, said chamber main frame has an upper conduit that allows said chamber right end internal area to communicate to the exterior, said chamber main frame has a lower conduit that allows said chamber left end internal area to communicate to the exterior, said chamber right end wall centered port allows said right lateral conduit internal areas to communicate with said chamber right end internal area, said chamber left end wall centered port allows said left lateral conduit internal areas to communicate with said chamber left end internal area, said chamber right end internal area allows said right piston to slide, said chamber left end internal area allows said left piston to slide, said chamber centered area allows said piston rod to slide and join said pistons, said piston rod center holds and allows the crankrod of said front crank to spin, said piston rod via said crankrod and the crankrollers of said front and back cranks communicates its sliding motion to said front and back cranks causing a rotary motion of the crankwheel and crankshaft of said front and back cranks or vice versa, said front and back cranks via said crankrollers cause said said chamber to slide, said chamber sliding motion and position controls the fluid flow from said chamber internal areas to said lateral conduits or vice versa, said fluid flow is caused by the sliding motion of said pistons or vice versa, said fluid flow forced into and out of said fluid motor or pump will cause said fluid motor or pump to act as a motor, said front crankshaft rotary motion will force fluid to flow into and out of said fluid motor or pump and cause said fluid motor or pump to act as a pump.

3. A fluid motor or pump which comprises a front crank, a piston rod, a right piston, a left piston, a chamber, a right lateral conduit, a left lateral conduit, an upper left corner conduit, an upper right corner conduit, a lower right corner conduit, a lower left corner conduit and a front wall which holds said four corner conduits, said front wall supports said front crank and allows the crankshaft to rotate, said corner conduits communicate with said lateral conduits and the exterior, said upper right corner conduit and said lower right corner conduit hold and communicate with said right lateral conduit, said right lateral conduit internal upper area communicates with said upper right corner conduit and said right lateral conduit internal lower area communicates with said lower right corner conduit, said upper left corner conduit and said lower left corner conduit hold and communicate with said left lateral conduit, said left lateral conduit internal upper area communicates with said upper left corner conduit and said left lateral conduit internal lower area communicates with said lower left corner conduit, said lateral conduits support and allow said chamber to slide, said chamber has a main frame and two end walls, said chamber main frame has two internal end areas and a centered area, said chamber main frame has an upper conduit with two one way output valves that allow said chamber internal areas to comunicate to the exterior, said chamber main frame has a lower conduit with two one way input valves that allow the exterior to communicate with said chamber internal areas, said chamber right end wall centered port allows said right lateral conduit internal areas to communicate with said chamber right end internal area, said chamber left end wall centered port allows said left lateral conduit internal areas to communicate with said chamber left end internal area, said chamber right end internal area allows said right piston to slide, said chamber left end internal area allows said left piston to slide, said chamber centered area allows said piston rod to slide and join said pistons, said piston rod center holds and allows the crankrod of said front crank to spin, said piston rod via said crankrod and the crankroller of said front crank communicates its sliding motion to said front crank causing a rotary motion of the crankwheel and crankshaft of said front crank or vice versa, said front crank via said crankroller causes said chamber to slide, said chamber sliding motion and position controls the fluid flow from said chamber internal areas to said lateral conduits or vice versa, said fluid flow is caused by the sliding motion of said pistons or vice versa, said fluid flow forced into and out of said fluid motor or pump will cause said fluid motor or pump to act as a motor, said crankshaft rotary motion will force fluid to flow into and out of said fluid motor or pump and cause said fluid motor or pump to act as a pump.

4. A fluid motor or pump which comprises a front crank, a back crank, a piston rod, a right piston, a left piston, a chamber, a right lateral conduit, a left lateral conduit, an upper left corner conduit, an upper right corner conduit, a lower right corner conduit, a lower left corner conduit and front and back walls which hold said four corner conduits, said back wall supports said back crank and allows the crankshaft of said back crank to rotate, said front wall supports said front crank and allows the crankshaft of said front crank to rotate, said corner conduits communicate with said lateral conduits and the exterior, said upper right corner conduit and said lower right corner conduit hold and communicate with said right lateral conduit, said right lateral conduit internal upper area communicates with said upper right corner conduit and said right lateral conduit internal lower area communicates with said lower right corner conduit, said upper left corner conduit and said lower left corner conduit hold and communicate with said left lateral conduit, said left lateral conduit internal upper area communicates with said upper left corner conduit and said left lateral conduit internal lower area communicates with said lower left corner conduit, said lateral conduits support and allow said chamber to slide, said chamber has a main frame and two end walls, said chamber main frame has two internal end areas and a centered area, said chamber main frame has an upper conduit with two one way output valves that allow said chamber internal areas to communicate to the exterior, said chamber main frame has a lower conduit with two one way input valves that allow the exterior to communicate with said chamber internal areas, said chamber right end wall centered port allows said right lateral conduit internal areas to communicate with said chamber right end internal area, said chamber left end wall centered port allows said left lateral conduit internal areas to communicate with said chamber left end internal area, said chamber right end internal area allows said right piston to slide, said chamber left end internal area allows said left piston to slide, said chamber centered area allows said piston rod to slide and join said pistons, said piston rod center holds and allows the crankrod of said front crank to spin, said piston rod via said crankrod and the crankrollers of said front and back cranks communicates its sliding motion to said front and back cranks causing a rotary motion of the crankwheel and crankshaft of said front and back cranks or vice versa, said front and back cranks via said crankrollers cause said said chamber to slide, said chamber sliding motion and position controls the fluid flow from said chamber internal areas to said lateral conduits or vice versa, said fluid flow is caused by the sliding motion of said pistons or vice versa, said fluid flow forced into and out of said fluid motor or pump will cause said fluid motor or pump to act as a motor, said front crankshaft rotary motion will force fluid to flow into and out of said fluid motor or pump and cause said fluid motor or pump to act as a pump.

* * * * *